US011518002B2

(12) United States Patent
Mohn et al.

(10) Patent No.: US 11,518,002 B2
(45) Date of Patent: Dec. 6, 2022

(54) METHOD FOR PRODUCING A GRINDING TOOL AND GRINDING TOOL

(71) Applicant: PFERD MILWAUKEE BRUSH COMPANY, INC., Milwaukee, WI (US)

(72) Inventors: Thomas Mohn, Iserlohn (DE); Bernd Stuckenholz, Bergisch Gladbach (DE); Achim Schmitz, Marienheide (DE)

(73) Assignee: PFERD MILWAUKEE BRUSH COMPANY, INC., Milwaukee, WI (US)

( * ) Notice: Subject to any disclaimer, the term of this patent is extended or adjusted under 35 U.S.C. 154(b) by 0 days.

(21) Appl. No.: 16/485,972

(22) PCT Filed: Feb. 14, 2017

(86) PCT No.: PCT/EP2017/053281
§ 371 (c)(1),
(2) Date: Aug. 14, 2019

(87) PCT Pub. No.: WO2018/149483
PCT Pub. Date: Aug. 23, 2018

(65) Prior Publication Data
US 2020/0061777 A1 Feb. 27, 2020

(51) Int. Cl.
*B24D 18/00* (2006.01)
*B24D 3/34* (2006.01)
*B24D 7/02* (2006.01)

(52) U.S. Cl.
CPC ..... *B24D 18/0072* (2013.01); *B24D 3/34* (2013.01); *B24D 3/346* (2013.01); *B24D 7/02* (2013.01); *B24D 18/00* (2013.01)

(58) Field of Classification Search
CPC ..... B24D 18/0072; B24D 3/346; B24D 2203/00; B24D 7/00; B24D 3/34;
(Continued)

(56) References Cited

U.S. PATENT DOCUMENTS 1,788,600 A * 1/1931 Smyser ..... B24D 11/005 51/306
2,370,636 A * 3/1945 Carlton ..... B05C 19/025 427/474
(Continued)

FOREIGN PATENT DOCUMENTS

CN 1141015 A 1/1997
CN 103313800 A 9/2013
(Continued)

OTHER PUBLICATIONS

Su, J., Zhang, Q., Wang, P.-C., MacDiarmid, A.G. and Wynne, K.J. (1998), Preparation and characterization of electrostrictive polyurethane films with conductive polymer electrodes. Polym. Adv. Technol., 9: 317-321. doi:10.1002/(SICI)1099-1581(199806)9:6<317::AID-PAT758>3.0.CO;2-Y (Year: 1998).*
(Continued)

*Primary Examiner* — Kevin E Yoon
*Assistant Examiner* — Marites A Guino-O Uzzle
(74) *Attorney, Agent, or Firm* — Browdy and Neimark, PLLC

(57) ABSTRACT

With a method for the production of a grinding tool, a tool base body is provided, which configures a three-dimensionally shaped adhesive sur-face by application of a bonding agent. The tool base body is positioned in a way that the adhesive surface is arranged in an electrostatic field, between a first electrode and a second electrode. Into the electrostatic field, abrasive grains are introduced, which, due to the electrostatic field, move towards the adhesive surface and adhere to same. The grinding tool produced in this manner has a three-dimensionally shaped abrasive grain layer. The production of the grinding tool is simple, flexible and economical. The grinding tool has a randomly shaped
(Continued)

abrasive grain layer and can be applied in a manifold manner with a high cutting performance and a long service life.

33 Claims, 5 Drawing Sheets

(58) Field of Classification Search
CPC . B24D 5/00; B24D 3/28; B24D 18/00; B24D 3/00; B24D 11/00; B24D 5/06; B24D 13/04; B24D 13/14; B24D 3/342; B24D 5/08; B24D 7/02; B24D 2201/00; B05D 1/04; B05D 1/06; B05D 5/00; C09K 3/14
See application file for complete search history.

(56) References Cited

U.S. PATENT DOCUMENTS

| | | | | |
|---|---|---|---|---|
| 2,898,279 | A | 8/1959 | Metcalfe et al. | |
| 8,869,740 | B2 | 10/2014 | Moren et al. | |
| 9,676,978 | B2 | 6/2017 | Moren et al. | |
| 9,969,057 | B2 | 5/2018 | Eugster et al. | |
| 2002/0061723 | A1* | 5/2002 | Duescher | B24D 18/00 451/527 |
| 2009/0305619 | A1 | 12/2009 | Schmied et al. | |
| 2011/0065369 | A1 | 3/2011 | Henn et al. | |
| 2011/0289854 | A1* | 12/2011 | Moren | B24D 11/001 51/295 |
| 2013/0008933 | A1 | 1/2013 | Clifford | |
| 2013/0312337 | A1* | 11/2013 | Moren | B05D 5/02 51/309 |
| 2015/0165592 | A1 | 6/2015 | Sawada | |
| 2016/0214232 | A1 | 7/2016 | Van | |

FOREIGN PATENT DOCUMENTS

| | | | | |
|---|---|---|---|---|
| EP | 0746447 | A1 * | 12/1996 | B29C 53/824 |
| EP | 2130646 | B1 | 6/2010 | |
| EP | 2578180 | A1 | 9/2012 | |
| GB | 559356 | A | 2/1944 | |
| JP | S62-152676 | A | 12/1985 | |
| JP | 9-509105 | A | 9/1997 | |
| JP | 102982554 | A | 1/2013 | |
| JP | 2013-530055 | A | 7/2013 | |
| JP | 2014508049 | A | 4/2014 | |
| JP | 2015-112709 | A | 6/2015 | |
| RU | 2 080 984 | C1 | 6/1997 | |
| SU | 724329 | A1 | 3/1980 | |
| WO | 95/22434 | A1 | 8/1995 | |
| WO | 95022434 | A1 | 8/1995 | |
| WO | WO-9522434 | A1 * | 8/1995 | B29C 53/824 |
| WO | 2009138114 | A1 | 11/2009 | |
| WO | 2012/112322 | A1 | 8/2012 | |
| WO | 2012112322 | A2 | 8/2012 | |
| WO | 2014206967 | A1 | 12/2014 | |
| WO | 2015/050781 | A1 | 4/2015 | |

OTHER PUBLICATIONS

Request for substantive examination dated Mar. 25, 2020 for corresponding Russian patent application No. 2019123294.
First Examination Report for Parallel Chinese Patent Application No. 2017 8008 6282.3 dated Sep. 3, 2020 and English Translation.
Notice of Reasons for Refusal dated Mar. 23, 2021, from corresponding Japanese Patent Application No. 2019-564577.
Chinese patent application No. 2017 8008 6282.3 the Chinese Patent Office dated Apr. 25, 2021 with English Translation.
Japanese Notice of Reason for Refusal issued in Japanese Application No. 2019-564577, with English Translation, dated Nov. 9, 2021.
European Office Action issued in European application No. 17705119.0, dated Dec. 7, 2021, with English Translation.
Third Party Observations filed in corresponding EP20170705119 dated Jun. 6, 2022, with English machine translation.
Brazilian Office Action of corresponding Brazilian Application No. BR112019015694-1 dated Jun. 14, 2022 with English translation.
European Office Action of corresponding European Application No. 17705119.0 dated Jun. 28, 2022 with English translation.
Japanese Office Action of corresponding Japanese Patent Application No. 2019-564577 dated Jul. 12, 2022 and English Translation.

* cited by examiner

METHOD FOR PRODUCING A GRINDING TOOL AND GRINDING TOOL

FIELD OF THE INVENTION

The invention relates to a method for the production of a grinding tool and a grinding tool.

BACKGROUND OF THE INVENTION

Hand-guided grinding tools for surface treatment are produced by means of bonded abrasives or by means of coated abrasives. From WO 2009/138 114 A1 (corresponds to US 2011/0065369 A1), for example, a rough grinding wheel is known, which comprises abrasive grains bonded with synthetic resin, i.e. bonded abrasives. On the other hand, from EP 2 130 646 A1 (corresponds to US 2009/0305619 A1) a flap disk is known, which comprises a support plate equipped with grinding lamellas. The grinding lamellas are made of coated abrasives and comprise abrasive grains, which are bonded to an underlayer by means of a bonding agent. Coated abrasives, as against bonded abrasives, have various advantages in the application of hand-guided grinding tools, as for example a higher cutting performance as well as a longer service life and lower personnel costs connected therewith, a reduced effort upon grinding as well as reduced noise and vibration exposure.

In the case of the flap disk known from EP 2 130 646 A1, the grinding lamellas, respectively, are bent around an outer circumferential rim of the support plate, with the result that the grinding lamellas, respectively, configure a three-dimensionally shaped abrasive grain layer. Due to this, the flap disk, in the case of manifold grinding applications, has a high cutting performance. It is disadvantageous that the flap disk is costly in production and three-dimensionally shaped abrasive grain layers can only be produced in limited amounts, since there is the danger of damaging the respective abrasive grain layer upon bending the grinding lamellas.

SUMMARY OF THE INVENTION

An object of the invention is to create a method which allows for simple, flexible and economical production of a grinding tool with a randomly shaped abrasive grain layer and a high cutting performance.

This object is achieved by a method for the production of a grinding tool, comprising the steps providing a tool base body, generating a three-dimensionally shaped adhesive surface by applying a bonding agent onto the tool base body, positioning the tool base body in a way that the adhesive surface is arranged in an electrostatic field between a first electrode and a second electrode, and introducing abrasive grains into the electrostatic field in a way that the abrasive grains, due to the electrostatic field, move towards the adhesive surface and adhere to the adhesive surface in order to configure a three-dimensionally shaped abrasive grain layer. By applying the bonding agent onto the tool base body, depending on the shape of the tool base body or a base body surface of the tool base body, a three-dimensionally shaped adhesive surface is produced. Due to the fact that the tool base body, including the adhesive surface, is positioned in an electrostatic field, into which abrasive grains are introduced, the tool base body is directly coated with the abrasive grains. The abrasive grains introduced into the electrostatic field move along the field lines in the direction of the adhesive surface and adhere to the tool base body upon contact with the adhesive surface or the bonding agent, with the result that the abrasive grains configure a three-dimensionally shaped abrasive grain layer, corresponding to the adhesive surface. The electrodes are configured of an electroconductive material in order to configure the electrostatic field. As the abrasive grains are directly applied onto the tool base body and the tool base body thus configures the base, the grinding tool—in comparison to the use of coated abrasives—can be produced in a simpler, more flexible and more economical manner. The abrasive grain layer, by providing a desired tool base body and applying the bonding agent, can be produced in a flexible manner with a randomly three-dimensionally shaped abrasive grain layer. As the abrasive grains move along the field lines, they can be applied in a desired manner onto the tool base body or the adhesive surface, depending on the course of the field lines and the position of the tool base body, with the result that a high cutting performance and a long service life of the grinding tool is ensured. The abrasive grains can move in the electrostatic field with the force of gravity or against the force of gravity towards the adhesive surface.

The tool base body is configured in a single-layer or in a multilayer manner. The tool base body comprises at least one material of the group of vulcanized fiber, polyester, glass fibers, carbon fibers, cotton, plastics and metal. The tool base body may also comprise a coated abrasive. The tool base body, at least section-wise, is flexible and/or rigid. The tool base body may have a hub or a shaft in order to tension and rotatably drive the grinding tool.

The bonding agent is at least one material of the group of thermosetting plastics, elastomers, thermoplastics and synthetic resins. Preferably, the bonding agent is a thermosetting plastic, in particular phenolic resin or epoxy resin. The phenolic resin, for example, is a resol or a novolak. The bonding agent can be applied in a random manner onto the tool base body.

The abrasive grains have a specific geometrical and/or a non-specific geometrical shape. The abrasive grains comprise at least one material chosen from the group of ceramics, corundum, in particular zircon corundum, diamond, cubic crystalline boron nitride (CBN), silicon carbide and tungsten carbide.

The abrasive grains can be applied in one layer or in multiple layers, with the result that at least one three-dimensionally shaped abrasive grain layer is configured on the tool base body. For the configuration of a multiple abrasive grain layers, a bonding agent is applied onto the respective abrasive grain layer below and the following abrasive grain layer is then applied in the manner already described, by means of the electrostatic field. The bonding agent thus configures a basic bond between the tool base body and the abrasive grain layer applied thereon, and configures an intermediate bond between two abrasive grain layers.

The adhesive surface or the abrasive grain layer is shaped in a random manner three-dimensionally, for example in a curved manner and/or in several planes aligned relative to one another, for example in transversely aligned planes. A curved configuration, for example, allows for the treatment of a fillet weld and/or the treatment of an edge. Due to transversely aligned planes, the abrasive grain layer configures a chamfer, which allows for rough machining or a two-dimensional treatment.

A method wherein the adhesive surface is curved in order to configure the three-dimensionally shaped abrasive grain layer ensures a simple, flexible and economical production. The curved adhesive surface or curved abrasive grain layer, in particular, allows for the production of grinding tools for the treatment of fillet welds and/or the treatment of edges. The adhesive surface or the abrasive grain layer, in particular, is curved concavely and/or convexly. The direction of curvature is defined, for example, in relation to a central longitudinal axis of the tool base body and/or to a tensioning side of the grinding tool, facing the tool drive. The adhesive surface or abrasive grain layer, for example, is configured cylindrically or spherically.

A method wherein the tool base body is moved relative to at least one of the electrodes in order to configure the three-dimensionally shaped abrasive grain layer ensures a simple, flexible and economical production. By moving the tool base body relative to at least one of the electrodes, a reliable and even application of the abrasive grains onto the adhesive surface, and thus a homogeneous abrasive grain layer, is ensured. Due to the movement, in particular, a distance, a position and/or an orientation of the tool base body relative to at least one of the electrodes is changed. The movement takes place, in particular at least partially, while the abrasive grains move towards the adhesive surface and adhere to same. The tool base body, for example, is moved by means of a handling device.

A method wherein a central longitudinal axis of the tool base body is aligned in various directions relative to the first electrode in order to configure the three-dimensionally shaped abrasive grain layer ensures a simple, flexible and economical production. Due to the fact that the central longitudinal axis of the tool base body is aligned in different directions, complexly shaped abrasive grain layers can be produced.

A method wherein the tool base body rotates around a central longitudinal axis in order to configure the three-dimensionally shaped abrasive grain layer ensures a simple, flexible and economical production. Due to a rotation of the tool base body around the central longitudinal axis, a quick and even application of the abrasive grains is possible. The rotation takes place, in particular, during the application of the abrasive grains. Preferably, a rotational speed can be adjusted, with the result that the application of the abrasive grains is possible in a simple and flexible manner. The rotational speed is adjusted, for example, depending on the size and/or the mass of the abrasive grains to be applied and/or depending on the desired thickness of the abrasive grain layer.

A method wherein the abrasive grains adhering to the adhesive surface, at least partially, are aligned towards the adhesive surface ensures a high cutting performance and a long service life. The field lines of the electrostatic field emerge or enter perpendicularly to the surfaces of the electrodes, with the result that the course of the field lines can be adjusted by the shape of the surface, the position and/or the orientation of the electrodes. By positioning the adhesive surface appropriately in relation to the field lines, the abrasive grains are applied with a desired orientation onto the adhesive surface. Due to the orientation, the grinding tool has a high cutting performance and a long service life.

A method wherein the abrasive grains are transported into the electrostatic field by means of a conveying device ensures a simple, flexible and economical production. By means of the conveying device, the abrasive grains are transported automatically into the electrostatic field and from there moved to the adhesive surface due to the electrostatic field. The conveying device, for example, can be operated in a continuous or a clocked manner. Preferably, the conveying device is operated depending on a movement of the tool base body. The conveying device, for example, is synchronized with the movement of the tool base body. A transport speed of the conveying device, in particular, can be adjusted.

A method wherein the conveying device comprises a conveyor belt ensures a simple, flexible and economical production. The conveyor belt allows for the configuration of an endless conveying device in a simple manner. The conveyor belt, for example, is guided around at least two pulleys and thus, for example, allows for a continuous operation of the conveying device. The conveyor belt, in particular, is configured in an electrically insulating manner.

A method wherein the first electrode is arranged below a conveying area of the conveying device ensures a simple, flexible and economical production. Due to the fact that the first electrode is arranged in a gravity direction below the conveying area, an introduction of abrasive grains into the electrostatic field is made possible in a simple manner. The conveying area, for example, is configured by the surface of a conveyor belt. The first electrode is arranged in a stationary or a displaceable manner. The first electrode, in particular, is configured in a plate-type manner. Preferably, the plate-type electrode essentially runs in parallel to the conveyor belt.

A method wherein the abrasive grains are supplied by means of a dosing device ensures a simple, flexible and economical production. The at least one dosing device directly feeds the abrasive grains into the electrostatic field and/or to the conveying device. The at least one dosing device doses and distributes the abrasive grains to be applied. Preferably, the at least one dosing device is arranged in front of a conveying device and supplies the abrasive grains to the conveying device. By means of the at least one dosing device, in particular, a grain mixture of abrasive grains is fed. In the grain mixture, the abrasive grains may vary in size, shape and/or material. The grain mixture, for example, can be mixed before the introduction into the dosing device, with the result that feeding the abrasive grains is possible with one single dosing device. Further on, several dosing devices can be provided, each containing exactly one type of abrasive grain, respectively, with the result that the grain mixture is mixed in a flexible manner by means of the dosing devices upon feeding. By means of the at least one dosing device, a dosing, distribution and/or orientation of the abrasive grains takes place.

A method wherein an electric voltage between the electrodes is adjustable ensures a simple, flexible and economical production. Due to adjusting the electric tension, the electrostatic field is adapted to the abrasive grains to be fed.

A method wherein the tool base body configures the second electrode ensures a simple and flexible production including a high cutting performance and a long service life. Due to the fact that the tool base body itself configures the second electrode, the second electrode is optimally adapted to the tool base body. The field lines enter or emerge perpendicularly to the adhesive surface into the tool base body or from the tool base body, with the result that the abrasive grains can be applied, aligned in a simple manner, to complex three-dimensionally shaped adhesive surfaces. The tool base body, at least section-wise or layer-wise, is electroconductive. Due to the fact that the tool base body configures the second electrode, also abrasive grain layers can be produced, which configure an undercut with the tool base body. In other words, the tool base body or the second electrode remains within the grinding tool and does not need to be ejected.

A method wherein on the tool base body, at least one electroconductive layer is configured ensures a simple and flexible production including a high cutting performance and a long service life. Due to the fact that the tool base body configures at least one electroconductive layer, it configures the second electrode by itself. The electroconductive layer, in particular, is arranged on a base body surface, for example on the front side and/or a rear side of the tool base body, and/or arranged on the inside. The tool base body, for example, is entirely configured of an electroconductive material.

A method wherein the applied bonding agent is electroconductive ensures a simple, flexible and economical production. The electroconductive bonding agent simplifies the application of the abrasive grains, as, for example, the configuration of a block field is avoided, and it interacts, in particular in an advantageous manner, with the tool base body, when the latter configures the second electrode.

A method wherein the tool base body, at least partially, is configured of an electroconductive material ensures a simple and flexible production including a high cutting performance and a long service life. Due to the electroconductive material, the tool base body itself configures the second electrode.

A method wherein the tool base body and the second electrode are configured separately from one another ensures a simple, flexible and economical production. Due to the fact that the second electrode is configured separately from the tool base body, the second electrode can be used for the production of a plurality of grinding tools. By the means of the separate second electrode, tool base bodies of random materials, in particular also of non-electroconductive materials, can be coated with abrasive grains.

A method wherein the second electrode, at least section-wise, is shaped corresponding to the tool base body ensures a simple and flexible production including a high cutting performance and a long service life. Due to the fact that the second electrode, at least section-wise, is shaped corresponding to the tool base body, the surface of the second electrode and the adhesive surface essentially run in parallel to one another, with the result that the field lines are aligned essentially perpendicularly to the adhesive surface. The abrasive grains are thus aligned in a desired manner during adhesion to the adhesive surface, which allows for a high cutting performance and a long service life. The second electrode, for example, is shaped entirely corresponding to the tool base body and is fully arranged on the tool base body. Furthermore, the second electrode, for example, is shaped corresponding to the tool base body in a section, and is moved relative to the tool base body during the application of the abrasive grains, wherein the second electrode essentially entirely slides over, in particular, the adhesive surface during the movement.

A method wherein the second electrode, at least section-wise, abuts on the tool base body ensures a simple and flexible production including a high cutting performance and a long service life. Due to the fact that the second electrode abuts on the tool base body, the surface of the second electrode essentially runs in parallel and/or near to the adhesive surface, with the result that the abrasive grains are applied to the adhesive surface with a desired orientation. By this means, a high cutting performance and a long service life are achieved.

Another object of the invention is to create a grinding tool that can be produced in a simple manner and applied flexibly, with a randomly shaped abrasive grain layer and a high cutting performance.

This object is achieved by a grinding tool comprising a tool base body and abrasive grains, wherein the abrasive grains are bonded to the tool base body by means of a bonding agent and configure an abrasive grain layer, wherein the abrasive grain layer is shaped three-dimensionally. The advantages of the grinding tool according to the invention correspond to the advantages already described in the context of the producing method according to the invention. The grinding tool may in particular also be specified with at least one feature of the inventive method. The abrasive grain layer is shaped three-dimensionally in a random manner, for example curved and/or in several planes aligned to one another, for example in planes transversely aligned to one another. A curved configuration, for example, allows for the treatment of a fillet weld and/or the treatment of an edge. Due to planes running transversely to one another, the abrasive grain layer configures a chamfer, which allows for rough machining or a two-dimensional treatment.

A grinding tool wherein the abrasive grain layer is curved can be applied flexibly. Due to the curved, in particular concavely and/or convexly curved, abrasive grain layer, the treatment of a fillet weld and/or the treatment of an edge are possible in a flexible manner.

A grinding tool wherein the abrasive grains, at least partially, are aligned towards the tool base body ensures a flexible application with high cutting performance and a long service life. Due to the fact that the abrasive grains are aligned to the tool base body, i.e. are aligned in the three-dimensionally shaped abrasive grain layer, the grinding tool has a high cutting performance and a long service live in the most various applications.

A grinding tool wherein the abrasive grains, respectively, have a maximum dimension D such that for at least 80%, in particular at least 90%, and in particular at least 95% of the abrasive grains: $1\ \mu m \leq D \leq 5000\ \mu m$, in particular $10\ \mu m \leq D \leq 2500\ \mu m$, and in particular $100\ \mu m \leq D \leq 1000\ \mu m$, ensures a simple production and a flexible application. Due to the size of the abrasive grains, the grinding properties of the grinding tool are adjusted in a desired manner. Due to a grain mixture of larger or coarse-grained abrasive grains and smaller or fine-grained abrasive grains, in particular, a specific adjustment of the chip spaces and thus a positive effect on the cutting performance and on the grinding layer or the abrasive grain layer is possible. The fine-grained abrasive grains have a maximum dimension $D_1$, whereas the coarse-grained abrasive grains have a maximum dimension $D_2$, provided that: $D_1 \leq D_2$.

A grinding tool wherein the abrasive grains, respectively, have a maximum dimension $D_1$ such that for at least 80%, in particular at least 90%, and in particular at least 95% of the abrasive grains: $1\ \mu m \leq D_1 \leq 5000\ \mu m$, in particular $5\ \mu m \leq D_1 \leq 500\ \mu m$, and in particular $10\ \mu m \leq D_1 \leq 250\ \mu m$, ensures a simple production and a flexible application. The abrasive grains are configured in a fine-grained manner. The fine-grained abrasive grains, in particular in connection with coarse-grained abrasive grains, serve as filler grains. The fine-grained abrasive grains are applied before, together with and/or after the coarse-grained abrasive grains. The fine-grained abrasive grains are applied in an electrostatic and/or mechanical manner. The coarse-grained abrasive grains, respectively, have a maximum dimension $D_2$, in particular provided that: $D_1 \leq D_2$.

A grinding tool wherein the abrasive grains, respectively, have a maximum dimension $D_2$ such that for at least 80%, in particular at least 90%, and in particular at least 95% of the abrasive grains: $1\ \mu m \leq D_2 \leq 5000\ \mu m$, in particular $150\ \mu m \leq D_2 \leq 3000\ \mu m$, and in particular $250\ \mu m \leq D_1 \leq 1500\ \mu m$, ensures a simple production and a flexible application. The coarse-grained abrasive grains are applied, in particular, in connection with fine-grained abrasive grains. In this case, the coarse-grained abrasive grains configure main grains and the fine-grained abrasive grains configure filler grains. The filler grains, for example, are made of normal corundum. The coarse-grained abrasive grains, for example, are made of ceramics. The fine-grained abrasive grains, respectively, have a maximum dimension $D_1$, in particular provided that: $D_1 \leq D_2$.

A grinding tool wherein a covering bond is applied onto the abrasive grain layer, wherein in particular a covering layer is applied onto the covering bond (27), ensures a flexible application with a high cutting performance and a long service life. After the application of the abrasive grain layer, the grinding tool or the bonding agent (basic bond) is hardened in the usual manner in an oven. In order to configure at least one covering bond as well as an additional covering layer, as necessary, a bonding agent is applied onto the abrasive grain layer. Due to the covering bond or the covering layer, the cutting performance and the service life are improved. The bonding agent, for example, is configured corresponding to the bonding agent for the configuration of the adhesive surface and, in the usual manner, can comprise active grinding filler materials such as, for example, cryolite and potassium tetrafluoroborate. The covering layer or the covering bond, preferably, is hardened in an oven.

Further features, advantages and details of the invention arise from the following description of several exemplary embodiments.

DESCRIPTION OF THE PREFERRED EMBODIMENTS

Figure 1:
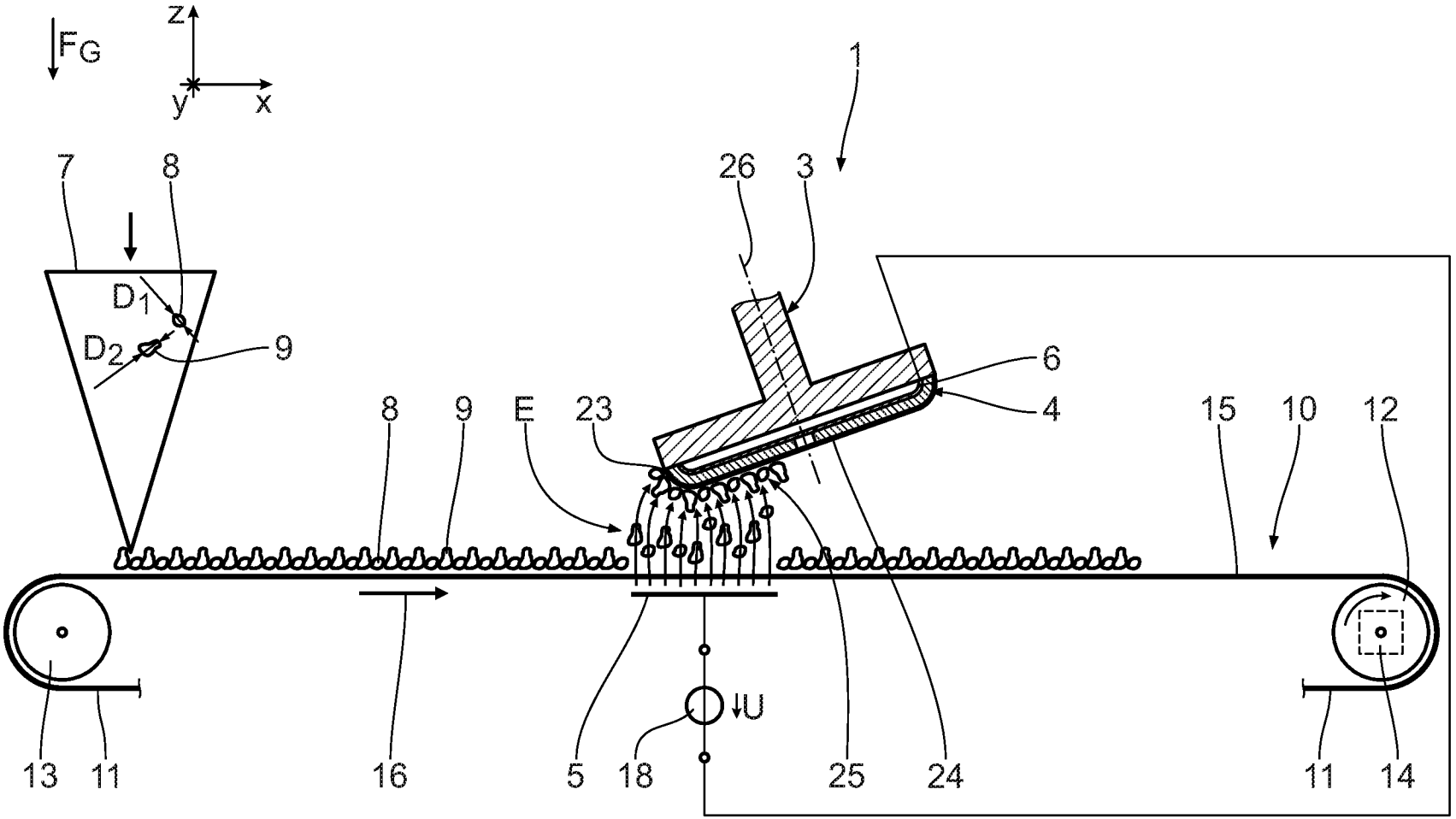
FIG. 1 shows a schematic view of a device for the production of a grinding tool by coating a tool base body with abrasive grains by means of an electrostatic field between two electrodes.
Figure 3:
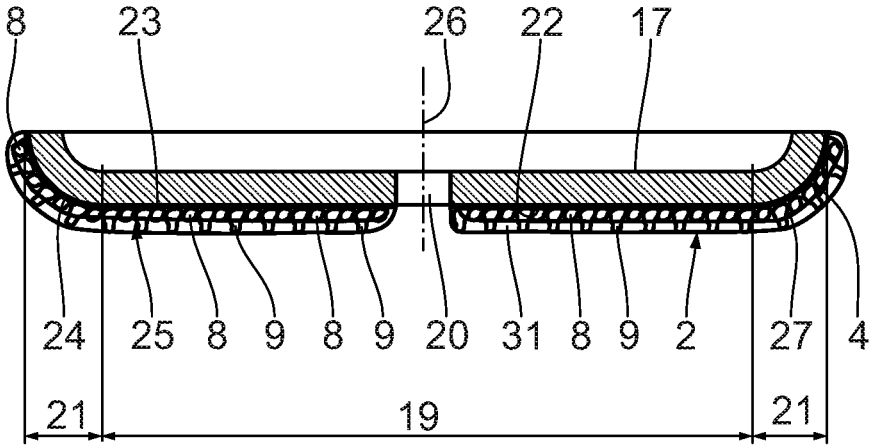
FIG. 3 shows a schematic sectional view of the finished grinding tool.

In the following, a first embodiment of the invention is described with reference to FIGS. 1 and 3. A device 1 for the production of a grinding tool 2 comprises a handling device 3 for handling and positioning a tool base body 4, a first electrode 5 and a corresponding second electrode 6 for generating an electrostatic field E, a dosing device 7 for supplying abrasive grains 8, 9 to a conveying device 10.

The conveying device 10 comprises an endless conveyor belt 11, which is tensioned by means of two pulleys 12, 13. The pulley 12, for example, is rotatably driven by means of an electric drive motor 14. A part of the conveyor belt 11, being arranged above the pulley 12, 13 in relation to the force of gravity $F_G$, configures a conveying area 15, which extends in a horizontal x direction and a horizontal y direction.

The dosing device 7 is arranged in front of the electrodes 5, 6, in a conveying direction 16. The first electrode 5 is configured in a plate-type manner and arranged below the upper part of the conveyor belt 11 or below the conveying area 15, in the direction of the force of gravity $F_G$. On the other hand, the second electrode 6 is arranged above the conveyor belt 11 or the conveying area 15, in relation to the force of gravity $F_G$. The second electrode 6 is thus spaced from the first electrode 5 in a vertical z direction, with the result that the conveying area 15 runs between the electrodes 5, 6. The x, y and z direction configure a Cartesian coordinate system.

The functionality of the device 1 is described in the following:

The second electrode 6 is configured separately from the tool base body 4 and shaped corresponding to the tool base body 4. The second electrode 6 is mounted to the handling device 3. The tool base body 4 is held by means of the handling device 3 in a way that the second electrode 6 essentially fully abuts on the rear side 17 of the tool base body 4. The handling device 3, holds the tool base body 4, for example, mechanically and/or pneumatically. Between the first electrode 5 and the second electrode 6, an electric voltage U is applied, which is generated by means of a voltage source 18 and is adjustable.

The tool base body 4 has a three-dimensional shape. In an inner area 19, the tool base body 4 is configured in a disk-like manner and, for example, has a hub 20. Alternatively, the tool base body 4 can have a shaft instead of the hub 20. A configuration without a hub 20 or a shaft is possible, is well. In contrast to this, the tool base body 4 is configured in a curved manner, in a circumferential area 21 around the area 19.

On a front side 22, turned away from the second electrode 6, first of all, a bonding agent 23 is applied, with the result that the bonding agent 23 arranged on the tool base body 4 configures a three-dimensionally shaped adhesive surface 24. The bonding agent 23, for example, is a resin, in particular phenolic resin. The tool base body 4 is made of a common material, such as, for example, vulcanized fiber or polyester. The bonding agent 23 is applied, for example, manually or by means of the handling device 3. For example, the tool base body 4 is immersed into the bonding agent 23 with the front side 22 by means of the handling device 3.

Figure 2:
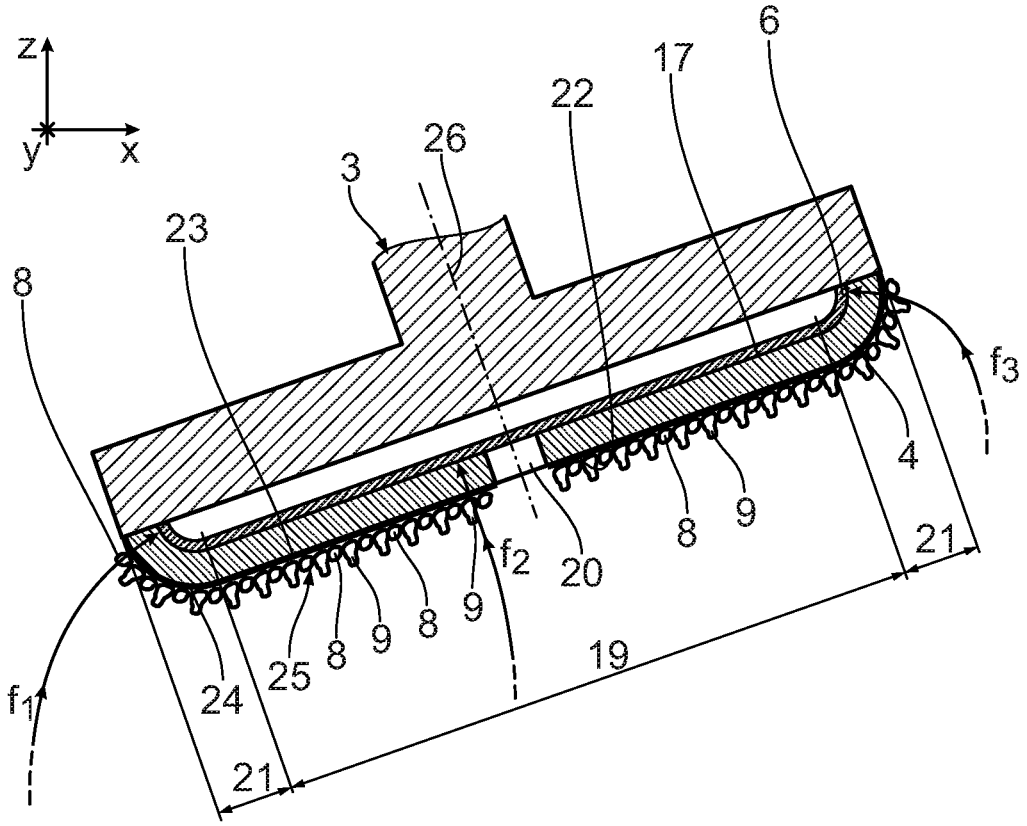
FIG. 2 shows an enlarged sectional view of the tool base body and the corresponding electrode in FIG. 1 according to a first embodiment.

Subsequently, the tool base body 4 is positioned above the first electrode in the z direction by means of the handling device 3, with the result that the adhesive surface 24 is partially arranged in the electrostatic field E, between the electrodes 5, 6. The field lines emerge perpendicularly out of the surface of the first electrode 5 and enter the surface of the second electrode 6 perpendicularly, with the result that the field lines essentially run perpendicularly through the adhesive surface 24. In FIG. 2, this is shown for the field lines $f_1$, $f_2$ and $f_3$, as an example.

By means of the conveying device 10, the abrasive grains 8, 9 are transported into the electrostatic field E in order to configure a three-dimensionally shaped abrasive grain layer 25. For this purpose, the dosing device 7, for example, provides a mixture of fine-grained abrasive grains 8 and of coarse-grained abrasive grains 9. The fine-grained abrasive grains 8, respectively, have a maximum dimension $D_1$, provided that for at least 80%, in particular at least 90%, and in particular at least 95% of the abrasive grains 8: $1\ \mu m \leq D_1 \leq 5000\ \mu m$, in particular $5\ \mu m \leq D_1 \leq 500\ \mu m$, and in particular $10\ \mu m \leq D_1 \leq 250\ \mu m$. In contrast to this, the coarse-grained abrasive grains 9, respectively, have a maximum dimension $D_2$, provided that for at least 80%, in particular at least 90% and in particular at least 95% of the abrasive grains 9: 1 μm≤$D_2$≤5000 μm, in particular 150 μm≤$D_2$≤3000 μm, and in particular 250 μm≤$D_2$≤1500 μm. In particular, it is provided that $D_1 \leq D_2$. The abrasive grains 8, 9, in the mixture, thus have the maximum dimension $D_1$ or $D_2$, wherein the maximum dimension in the mixture is generally named as D. In the mixture, the abrasive grains 8, 9 thus have the maximum dimension D, provided that for at least 80%, in particular at least 90%, and in particular at least 95% of the abrasive grains 8, 9: 1 μm≤D≤5000 μm, in particular 10 μm≤D≤2500 μm, and in particular 100 μm≤D≤1000 μm.

The abrasive grains 8, 9 are supplied to the conveyor belt 11 in a dosed manner by means of the dosing device 7, and they are distributed on same. By means of the, for example, electric drive motor 14, the conveyor belt 11 with the abrasive grains 8, 9 arranged thereon is moved in the conveying direction 16, with the result that the abrasive grains 8, 9 are introduced into the electrostatic field E. By means of the, for example, electric drive motor 14, the transport speed in the conveying direction 16 can be adjusted.

Due to the electrostatic field E, the abrasive grains 8, 9 are moved against the force of gravity $F_G$ towards the adhesive surface 24, and they are aligned along the field lines, for example the field lines $f_1$, $f_2$ and $f_3$. When the abrasive grains 8, 9 hit the adhesive surface 24, they adhere thereto. Due to the adhering abrasive grains 8, 9, the abrasive grain layer 25 is configured on the tool base body 4. In order to apply the abrasive grains 8, 9 evenly and homogeneously, the tool base body 4 is rotated around a central longitudinal axis 26 by means of the handling device 3. Between the coarse-grained abrasive grains 9, fine-grained abrasive grains 8 adhere to the tool base body 4, with the result that die abrasive grain layer 25 is configured homogeneously. The coarse-grained abrasive grains 9, in this case, configure main grains and the fine-grained abrasive grains 8 configure filler grains. The abrasive grain layer 25 is shaped three-dimensionally or in a curved manner, corresponding to the adhesive surface 24. Additionally, the tool base body 4, if needed, is moved in a way that the central longitudinal axis 26 is aligned in various directions towards the first electrode 5.

After the application of the abrasive grain layer 25 onto the tool base body 4 has been finished, the tool base body 4, together with the bonding agent 23 and the abrasive grain layer 25, configures a semi-finished product. The semi-finished product is loosened from the handling device 3 and is arranged in a heating device, where the bonding agent 23 is hardened. Subsequently, at least one covering bond 27 as well as—if needed—a covering layer 31 are applied onto the abrasive grain layer 25 in the common manner. The covering bond 27, for example, has a bonding agent 23 with additional active grinding filler materials. The covering layer 31 is applied onto the covering bond 27. The covering layer 31 has a bonding agent 23 with additional active grinding filler materials, wherein the proportion of active grinding filler materials, preferably, is higher than the one in the covering bond 27. The covering bond 27 and the covering layer 31, for example, are applied manually. Subsequently, the covering bond 27 and the covering layer 31 are hardened in a heating device. The bonding agent 23, for example, comprises phenolic resin and chalk. The covering bond 27 and the covering layer 31, for example, comprise phenolic resin, chalk and cryolite. The atmospheric humidity during the production is for example 0% to 100%, in particular 35% to 80%. In FIG. 3, the finished grinding tool 2 is shown.

Figure 4:
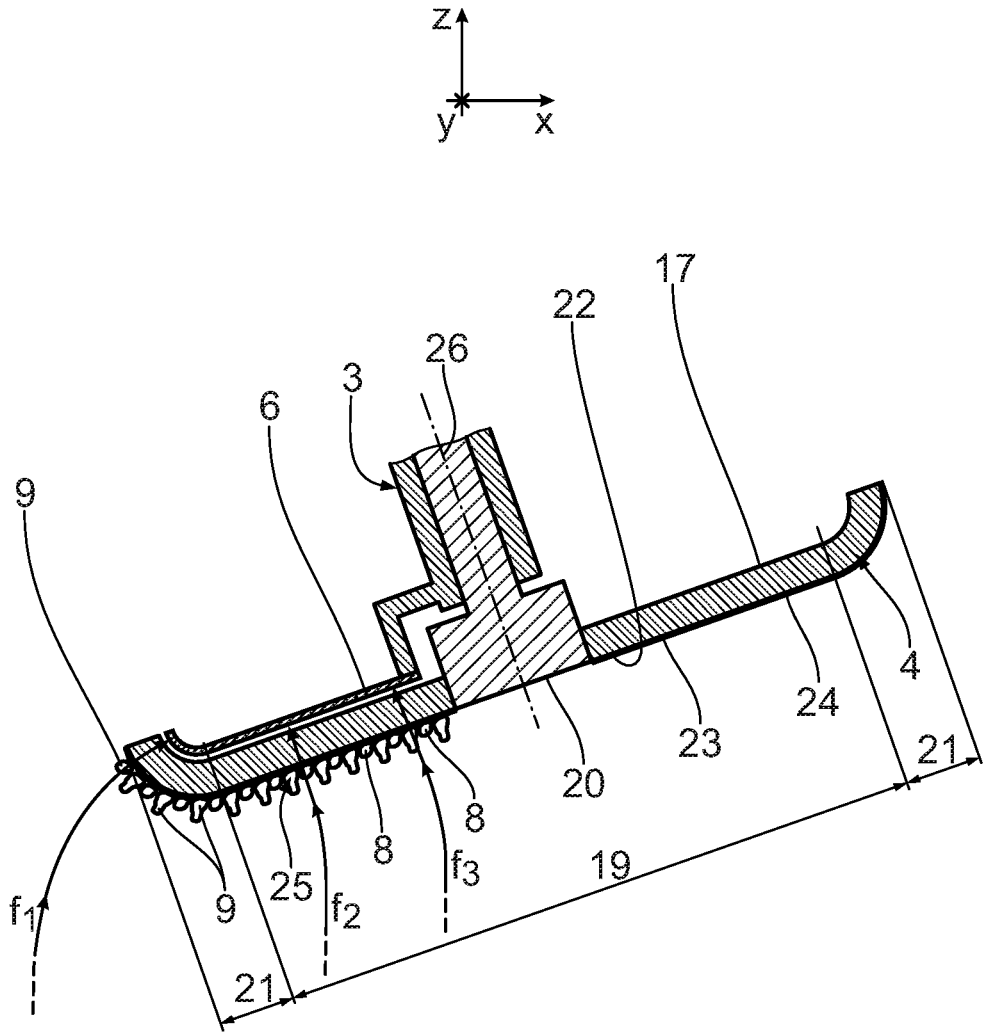
FIG. 4 shows a sectional view of a tool base body and a corresponding electrode according to a second embodiment.

In the following, a second embodiment of the invention is described with reference to FIG. 4. In contrast to the first embodiment, the second electrode 6 is configured smaller than the tool base body 4 and only covers a portion of the tool base body 4. In this portion, the second electrode 6 is shaped corresponding to the tool base body 4, with the result that the second electrode 6 essentially runs in parallel to the adhesive surface 24. The second electrode 6 does not abut on the rear side 17 of the tool base body 4, however is slightly spaced from same. The second electrode 6 is firmly connected with the handling device 3, whereas the tool base body 4 is rotated around the central longitudinal axis 26 by means of the handling device 3. The tool base body 4 thus is moved relative to the second electrode 6 by the rotation around the central longitudinal axis 26. The abrasive grains 8, 9 move in the direction of the adhesive surface 24 in the area of the electrostatic field E and, upon contact with the adhesive surface 24, adhere to same. As the tool base body 4 moves relative to the second electrode 6, i.e. rotates around the central longitudinal axis 26, the entire adhesive surface 24 is coated with the abrasive grains 8, 9. In view of the further setup of the device 1 as well as its functionality, and of the further setup of the grinding tool 2, reference is made to the preceding embodiment.

Figure 5:
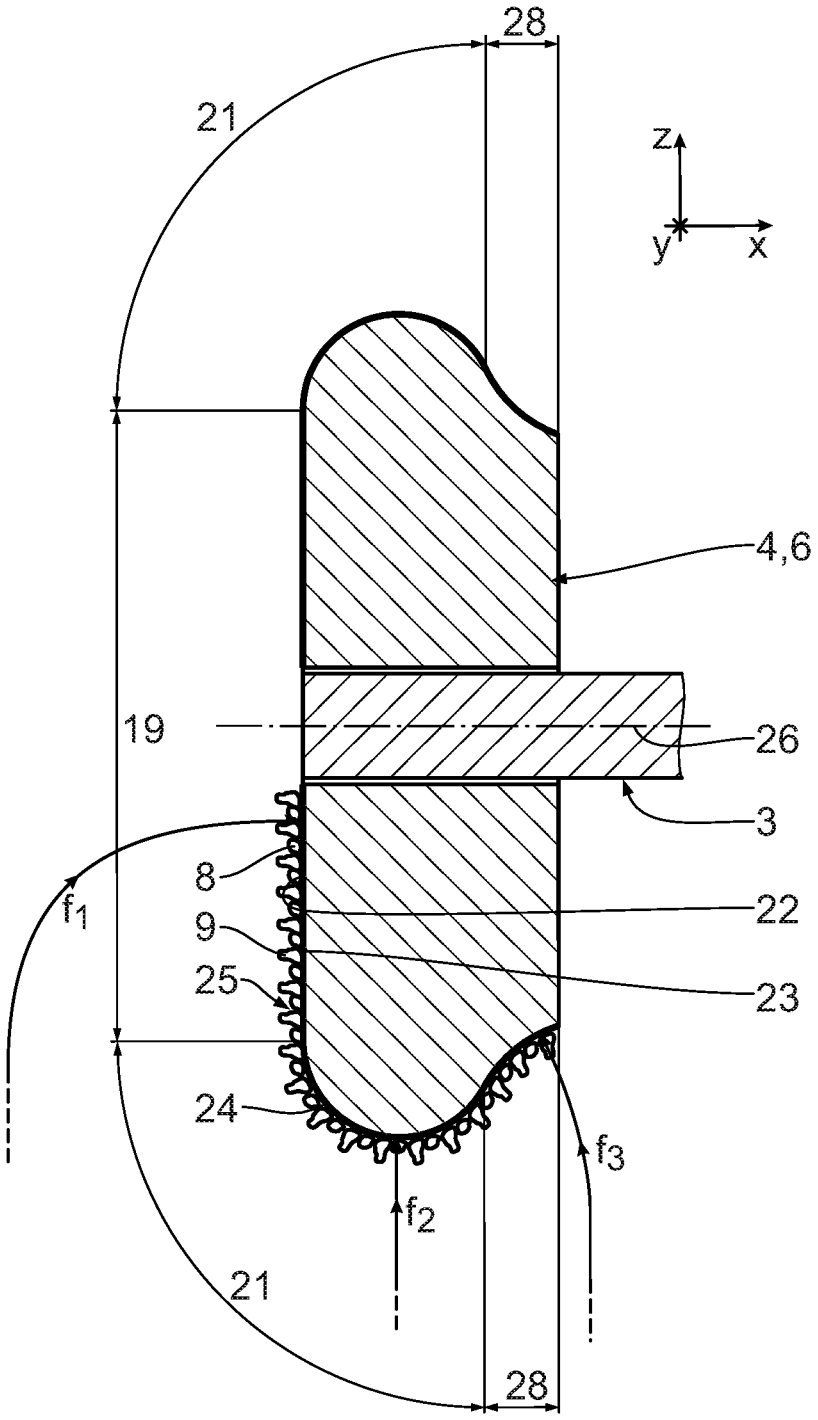
FIG. 5 shows a sectional view of a tool base body configured as an electrode according to a third embodiment.

In the following, a third embodiment is described with reference to FIG. 5. In contrast to the preceding embodiments, the tool base body 4 itself is configured as a second electrode 6. For this purpose, the tool base body 4 is made of an electroconductive material, in particular of a metal. The tool base body 4, for example, is made of aluminum. The tool base body 4 shown in FIG. 5, in addition to the even inner area 19 and the convexly curved area 21, shows a concavely curved area 28. The adhesive surface 24 thus is shaped three-dimensionally in a complex manner. The applied bonding agent 23 is electroconductive in order to avoid a block field and to optimize the electrostatic field E. The electroconductive bonding agent 23, for example, is a conductive varnish. The field lines $f_1$ to $f_3$ again run perpendicularly through the adhesive surface 24, with the result that abrasive grains 8, 9, despite the complexly shaped adhesive surface 24, are applied thereto in an aligned manner. The central longitudinal axis 26 essentially runs within the x-y plane, with the result that, by a rotation of the tool base body 4 around the central longitudinal axis, the inner area 19 as well as the areas 21 and 28 are reliably and homogeneously coated with the abrasive grains 8, 9. In view of the further setup of the device 1 as well as its functionality, and of the further setup of the grinding tool 2, reference is made to the preceding embodiments.

Figure 6:
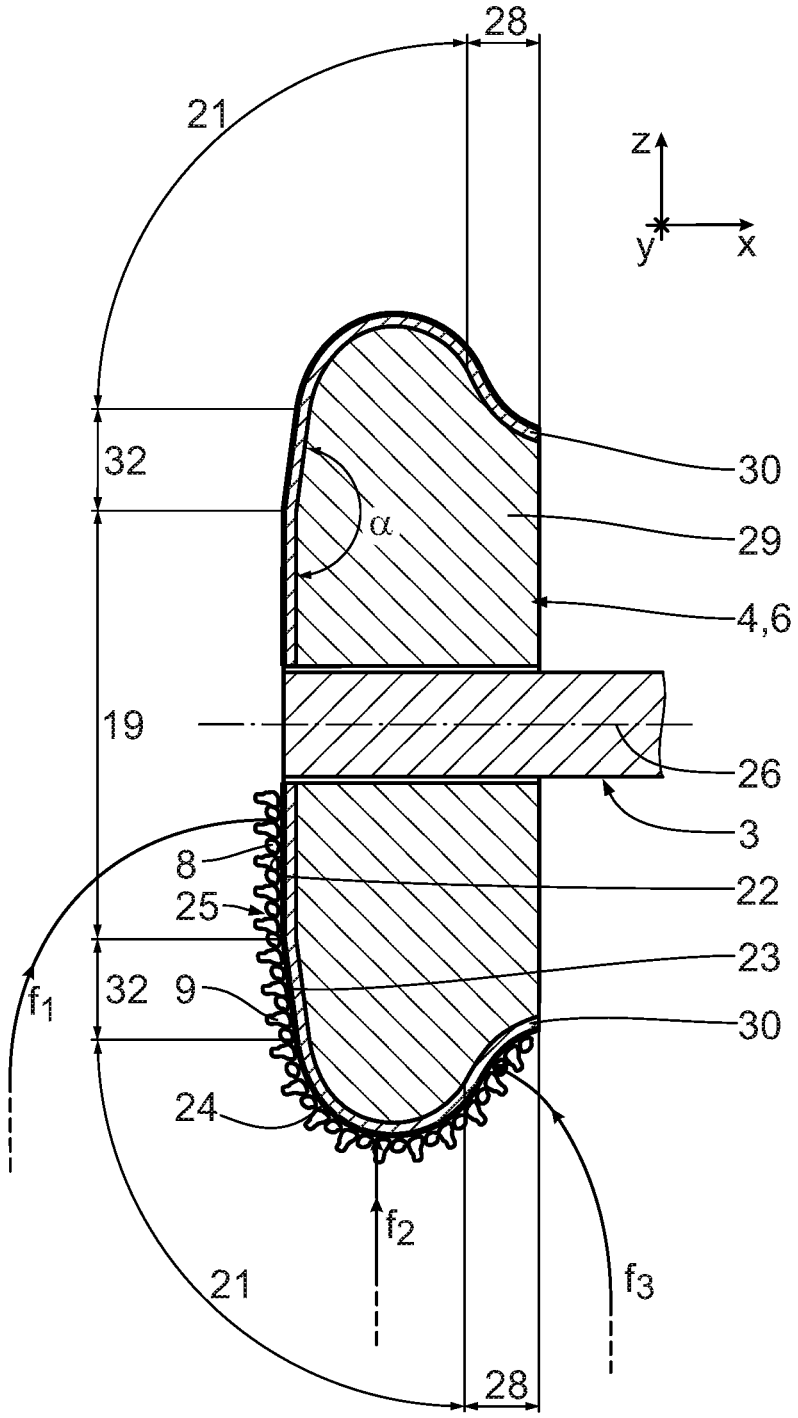
FIG. 6 shows a sectional view of a tool base body configured as an electrode according to a fourth embodiment.

In the following, a fourth embodiment of the invention is described with reference to FIG. 6. In contrast to the preceding embodiments, the tool base body 4 comprises a base body 29 made of a non-electroconductive material and an electroconductive layer 30 firmly connected with the base body 29. Due to the electroconductive layer 30, the tool base body 4 itself configures the second electrode 6. The layer 30, for example, is a copper foil. The bonding agent 23 is applied onto the electroconductive layer 30, with the result that the adhesive surface 24 is configured. The bonding agent 23 can be electroconductive. The tool base body 4 shows the inner area 19, the convexly curved area 21 and the concavely curved area 28. Between the inner area 19 and the convexly curved area 21, a chamfered area 32 or a chamfer is arranged. The chamfered area 32 and the inner area 19 form an angle α, provided that α≠180°. The chamfered area 32, for example, serves for rough machining or for two-dimensional treatment. The tool base body 4 rotates around the central longitudinal axis 26, with the result that the adhesive surface 24, despite the complex three-dimensional shape, is reliably and evenly coated with the abrasive grains 8, 9. The configured abrasive grain layer 25, due to the concave and convex curvature as well as the chamfer or the chamfered area 32, is shaped three-dimensionally in a complex manner. In view of the further setup of the device 1 as well as its functionality, and of the setup of the grinding tool 2, reference is made to the preceding embodiments.

The method according to the invention has a low number of production steps and in particular avoids a transformation of coated abrasives. The method according to the invention allows for the production of grinding tools 2 including complexly three-dimensionally shaped abrasive grain layers 25 for a plurality of various applications. The cutting performance as well as the service life of the grinding tools 2, in this case, are comparable to grinding tools produced of coated abrasives. Due to the electrostatic application of the abrasive grains 8, 9, in particular, it is rendered possible that the abrasive grains 8, 9, with their respective longitudinal axis, are aligned perpendicularly to the adhesive surface 24 or the surface of the tool base body 4. This ensures a high cutting performance and a long service life. Additionally, the grinding tools 2 according to the invention, compared to coated abrasives, show lower noise and vibration exposure as well as lower effort in the application.

The invention claimed is:

1. A method for the production of a grinding tool, comprising the steps:

providing a tool base body, wherein the tool base body has at least one of a hub and a shaft in order to tension and rotatably drive the grinding tool around a central longitudinal axis and wherein the tool base body is at least section-wise rigid to rotate the grinding tool around the central longitudinal axis, generating a three-dimensionally shaped adhesive surface by applying a bonding agent onto the tool base body, positioning the tool base body in a way that the three-dimensionally shaped adhesive surface is arranged in an electrostatic field between a first electrode and a second electrode, and introducing abrasive grains into the electrostatic field in a way that the abrasive grains, due to the electrostatic field, move towards the three-dimensionally shaped adhesive surface and adhere to the three-dimensionally shaped adhesive surface in order to configure a three-dimensionally shaped abrasive grain layer, wherein the abrasive grains are directly applied onto the tool base body such that the tool base body configures a base and the three-dimensionally shaped abrasive grain layer is firmly bonded to the tool base body after the bonding agent is hardened, wherein the three-dimensionally shaped abrasive grain layer is curved in a radial direction and a circumferential direction with respect to the central longitudinal axis.

2. The method according to claim 1, wherein the three-dimensionally shaped adhesive surface is curved in order to configure the three-dimensionally shaped abrasive grain layer.

3. The method according to claim 1, wherein the tool base body is moved relative to at least one of the electrodes in order to configure the three-dimensionally shaped abrasive grain layer.

4. The method according to claim 1, wherein the central longitudinal axis of the tool base body is aligned in various directions relative to the first electrode in order to configure the three-dimensionally shaped abrasive grain layer.

5. The method according to claim 1, wherein the tool base body rotates around the central longitudinal axis in order to configure the three-dimensionally shaped abrasive grain layer.

6. The method according to claim 1, wherein the abrasive grains adhering to the adhesive surface, at least partially, are aligned towards the adhesive surface.

7. The method according to claim 1, wherein the abrasive grains are transported into the electrostatic field by means of a conveying device.

8. The method according to claim 7, wherein the conveying device comprises a conveyor belt.

9. The method according to claim 7, wherein the first electrode is arranged below a conveying area of the conveying device.

10. The method according to claim 1, wherein the abrasive grains are supplied by means of a dosing device.

11. The method according to claim 1, wherein an electric voltage between the electrodes is adjustable.

12. The method according to claim 1, wherein the tool base body configures the second electrode.

13. The method according to claim 1, wherein on the tool base body, at least one electroconductive layer is configured.

14. The method according to claim 1, wherein the applied bonding agent is electroconductive.

15. The method according to claim 1, wherein the tool base body, at least partially, is configured of an electroconductive material.

16. The method according to claim 1, wherein the tool base body and the second electrode are configured separately from one another.

17. The method according to claim 1, wherein the second electrode, at least section-wise, is shaped corresponding to the tool base body.

18. The method according to claim 1, wherein the second electrode, at least section-wise, abuts on the tool base body.

19. A grinding tool comprising:

a tool base body, wherein the tool base body has at least one of a hub and a shaft in order to tension and rotatably drive the grinding tool around a central longitudinal axis and wherein the tool base body is at least section-wise rigid to rotate the grinding tool around the central longitudinal axis, and abrasive grains, wherein the abrasive grains are directly applied onto the tool base body and the tool base body configures a base, wherein the abrasive grains are bonded to the tool base body by a bonding agent and configure an abrasive grain layer, and wherein the abrasive grain layer is shaped three-dimensionally, wherein the three-dimensionally shaped abrasive grain layer is firmly bonded to the tool base body after the bonding agent is hardened, and wherein the three-dimensionally shaped abrasive grain layer is curved in a radial direction and a circumferential direction with respect to the central longitudinal axis.

20. The grinding tool according to claim 19, wherein the abrasive grain layer is curved.

21. The grinding tool according to claim 19, wherein the abrasive grains, at least partially, are aligned towards the tool base body.

22. The grinding tool according to claim 19, wherein the abrasive grains, respectively, have a maximum dimension D such that for at least 80%, of the abrasive grains: 1 μm≤D≤5000 μm.

23. The grinding tool according to claim 19, wherein the abrasive grains, respectively, have a maximum dimension D1 such that for at least 80% of the abrasive grains: 1 μm≤D1≤5000 μm.

24. The grinding tool according to claim 19, wherein the abrasive grains, respectively, have a maximum dimension D2 such that for at least 80% of the abrasive grains: 1 μm≤D2≤5000 μm.

25. The grinding tool according to claims 19, wherein a covering bond is applied onto the abrasive grain layer.

26. The method according to claim 1, wherein the tool base body is configured in a disc-like manner in an inner area and in a curved manner in a circumferential area around the inner area.

27. The method according to claim 26, wherein the at least one of the hub and the shaft is arranged in the inner area of the tool base body.

28. The grinding tool according to claim 19, wherein the tool base body is configured in a disc-like manner in an inner area and in a curved manner in a circumferential area around the inner area.

29. The grinding tool according to claim 28, wherein the at least one of the hub and the shaft is arranged in the inner area of the tool base body.

30. The grinding tool according to claim 1, wherein the three-dimensionally shaped adhesive surface and the three-dimensionally shaped abrasive grain layer are each curved from a first plane parallel to the tool base body towards a second plane perpendicular to the first plane.

31. The grinding tool according to claim 1, wherein the three-dimensionally shaped adhesive surface and the three-dimensionally shaped abrasive grain layer are each shaped in a curved manner between two transverse planes, one of which is perpendicular to the central longitudinal axis.

32. The grinding tool according to claim 1, wherein at least one non-electroconductive material of the tool base body is coated with abrasive grains.

33. The grinding tool according to claim 19, wherein at least one non-electroconductive material of the tool base body is coated with abrasive grains.

* * * * *